US006481120B1

(12) United States Patent
Xia et al.

(10) Patent No.: US 6,481,120 B1
(45) Date of Patent: Nov. 19, 2002

(54) FULL LENGTH INSOLE FOR ARTHRITIC AND/OR DIABETIC PEOPLE

(75) Inventors: Bin Xia, Germantown, TN (US); Harold Howlett, Nesbit, MS (US); Kellie Goodrich, Memphis, TN (US); Laura J. Crane, Williston, TN (US); Daniel B. Snyder, Collierville, TN (US)

(73) Assignee: Schering-Plough Healthcare Products, Inc., Memphis, TN (US)

( * ) Notice: Subject to any disclaimer, the term of this patent is extended or adjusted under 35 U.S.C. 154(b) by 0 days.

(21) Appl. No.: 09/628,900

(22) Filed: Jul. 31, 2000

(51) Int. Cl.[7] ..... A43B 13/40
(52) U.S. Cl. ..... 36/44; 36/140
(58) Field of Search ..... 36/44, 28, 140, 36/30 R

(56) References Cited

U.S. PATENT DOCUMENTS 3,624,930 A * 12/1971 Johnson et al.
4,435,910 A * 3/1984 Marc
4,513,518 A * 4/1985 Jalbert et al.
4,534,121 A * 8/1985 Autry
4,619,056 A * 10/1986 Lin et al.
4,627,179 A * 12/1986 McElroy
4,823,483 A * 4/1989 Chapnick
5,463,824 A * 11/1995 Barna
6,199,304 B1 * 3/2001 Ludemann

* cited by examiner

*Primary Examiner*—Ted Kavanaugh
(74) *Attorney, Agent, or Firm*—Robert J. Lipka

(57) ABSTRACT

A removable insole for insertion into footwear, includes a forefoot portion extending at least to metatarsals of a foot, the forefoot portion including a combination layer formed from a bottom layer of a resilient foam material which provides a shock absorption cushioning function, and a top layer of a slow recovery material which absorbs shear forces applied to the second layer at pressure points and spreads out the shear forces along the forefoot portion, the top layer being of substantially the same dimensions as the bottom layer and superposed therewith, the bottom and top layers having the same thickness and outer dimensions; a cupped heel portion formed by a relatively flat central portion and a sloped side wall; a mid-foot portion connecting together the forefoot portion and the heel portion, the mid-foot portion including a medial arch portion and being connected to the forefoot portion at the medial arch portion, the heel portion and mid-foot portion together being formed by a unitary layer of resilient material, and the sloped side wall extending around a periphery of the heel portion and forwardly to at least the mid-foot portion of the insole; and a top cover secured to upper surfaces of the forefoot portion, mid-foot portion and heel portion.

11 Claims, 9 Drawing Sheets

FULL LENGTH INSOLE FOR ARTHRITIC AND/OR DIABETIC PEOPLE

BACKGROUND OF THE INVENTION

The present invention relates generally to shoe insoles, and more particularly, to improved insoles particularly adapted for arthritic and/or diabetic people.

In the United States, 42.7 million people are affected by arthritis. This number is expected to grow to 60 million people in the year 2020. Arthritis is the leading cause of disability among people ages 15 or older.

Due to rheumatoid inflammation, all lower extremity joints and the back can experience pain, fatigue and discomfort. Arthritic people commonly experience forefoot pain and swelling in the metatarsal area. This results from a remodeling of the foot, that is, a structural change in the forefoot. Specifically, depressed or prominent metatarsal heads are formed, which result in bony protuberances, and thereby pressure points, at the bottom of the foot, which can be very painful. This, of course, causes impaired ambulatory ability and gait. Further, deformation of foot joints in arthritic people can produce excessive plantar pressure, which will worsen the pain and discomfort in the foot. Arthritic people also experience mid-foot/arch problems.

It has been suggested by Kendon J. Conrad et al, "Impacts of Foot Orthoses on Pain and Disability in Rheumatoid Arthritics", J. Clin. Epidemiol., Vol. 49, No. 1, pages 1–7, 1996, to use functional posted foot orthoses to provide symptomatic relief of pain in arthritic people. However, Conrad et al concluded from randomized clinical trials that functional posted foot orthoses provide little, if any, benefit over placebo foot orthoses in limiting disability or pain. There as also no indication as to how the foot orthoses were posted. The article does state that the results are contrary to previous tests and beliefs.

In a later article by Meredith B. Marks et al in The Lancet, there is a discussion of the Conrad et al findings. It is stated therein that foot orthoses are commonly used in the management of patients with rheumatoid arthritis who commonly complain of foot pain and deformity due to the combined effects of inflammation, bony destruction and connective tissue damage. Marks et al state that Conrad et al used a corrective wedge as the functional posted foot orthoses, which was made from a rigid thermoplastic material. It was stated that the posting was performed on the basis of a clinical assessment made by a podiatrist, with the aim of limiting pronation by maintaining the subtalar joint in a neutral position at mid-stance, thereby limiting stresses on the forefoot that promote hallux valgus deformities. It was also stated that there is no indication as to how such correction was provided to achieve this positioning. It was, however, further stated that metatarsal relief, in the form of a pad or bar proximal to the metatarsal joints, was not incorporated into the orthoses. It was acknowledged that the Conrad et al study was the first study in a double-blind randomized manner. Marks et al indicate, as well, that the Conrad et al finding is contrary to findings of previous uncontrolled trials and to prevailing beliefs about good clinical practice. Marks et al suggest that more effective pain relief might have been provided by orthoses made from a material with more shock-absorbing properties than Rohadur used in the Conrad et al tests, and including metatarsal relief.

It is also estimated that there are 15.7 million diabetic people in the United States. Because of the deterioration of the soft tissue and neuropathy, diabetic people tend to experience high pressure on the bottom of their feet, especially under the ball of the foot. This high pressure forms high local pressure spots in the forefoot, causing plantar ulceration, and ultimately may result in amputation when patients lose the protective sensation. In fact, this makes diabetes the leading cause of lower extremity amputations. This is because the tissue in the forefoot is sensitive to shear, that is, twisting and torsion, and excessive shear causes the foot ulcers. Therefore, it is important that the shear in the forefoot be absorbed to avoid this problem.

SUMMARY OF THE INVENTION

Accordingly, it is an object of the present invention to provide an insole that overcomes the problems with the aforementioned prior art.

It is another object of the present invention to provide an insole particularly suited for diabetic and arthritic people.

It is still another object of the present invention to provide an insole which reduces lower extremity, back and foot pain.

It is yet another object of the present invention to provide an insole which optimally accommodates deformation of the forefoot region and reduces foot plantar pressure in the forefoot region.

It is a further object of the present invention to provide an insole which substantially reduces peak pressure in the midfoot and heel regions.

It is a still further object of the present invention to provide an insole which provides extra stabilization and support in the midfoot arch area.

It is a yet further object of the present invention to provide an insole that is easy and economical to make and use.

In accordance with an aspect of the present invention, a removable insole for insertion into footwear, includes a forefoot portion extending at least to metatarsals of a foot, the forefoot portion including a combination layer formed from a first layer of a resilient material which provides a shock absorption cushioning function, and a second layer of a slow recovery material which absorbs shear forces applied to the second layer at pressure points and spreads out the shear forces along the forefoot portion, the second layer having substantially the same outer dimensions as the first layer and superposed therewith; a heel portion; and a mid-foot portion connecting together the forefoot portion and the heel portion, the mid-foot portion including a medial arch portion.

Preferably, the first layer is the bottom layer and the second layer is the top layer superposed on the bottom layer. A rear edge of the combination layer is connected with a front edge of the mid-foot portion, and the connection occurs at the medial arch portion. Each of the first and second layers has a substantially identical thickness. Unlike the forefoot portion, the mid-foot portion and heel portion are formed by a unitary layer of resilient material.

A top cover is also secured to upper surfaces of the forefoot portion, mid-foot portion and heel portion.

Also, at least one pattern trim line is formed at the forefoot portion for trimming the insole to fit into smaller-size footwear.

The medial arch portion has a height greater than a remainder of the mid-foot portion, and includes spaced apart, transverse oriented grooves at the underside defining transverse flex members therebetween which effectively function as springs.

The heel portion includes a plurality of depressions at the underside which form spaced apart spring walls therebetween, the spring walls having lower edges generally coplanar with a lower surface of the heel portion.

Preferably, the heel portion is cupped so as to be formed by a relatively flat central portion and a sloped side wall. The sloped side wall extends around a periphery of the heel portion and forwardly to at least the mid-foot portion of the insole.

In accordance with another aspect of the present invention, footwear includes an outer sole; an inner sole connected to the outer sole, the inner sole including a forefoot portion extending at least to metatarsals of a foot, the forefoot portion including a combination layer formed from a first layer of a resilient material which provides a shock absorption cushioning function, and a second layer of a slow recovery material which absorbs shear forces applied to the second layer at pressure points and spreads out the shear forces along the forefoot portion, the second layer having substantially the same outer dimensions as the first layer and superposed therewith, a heel portion, and a mid-foot portion connecting together the forefoot portion and the heel portion, the mid-foot portion including a medial arch portion; and an upper connected to at least one of the outer sole and the inner sole.

The above and other features of the invention will become readily apparent from the following detailed description thereof which is to be read in connection with the accompanying drawings.

DETAILED DESCRIPTION

Figure 1:
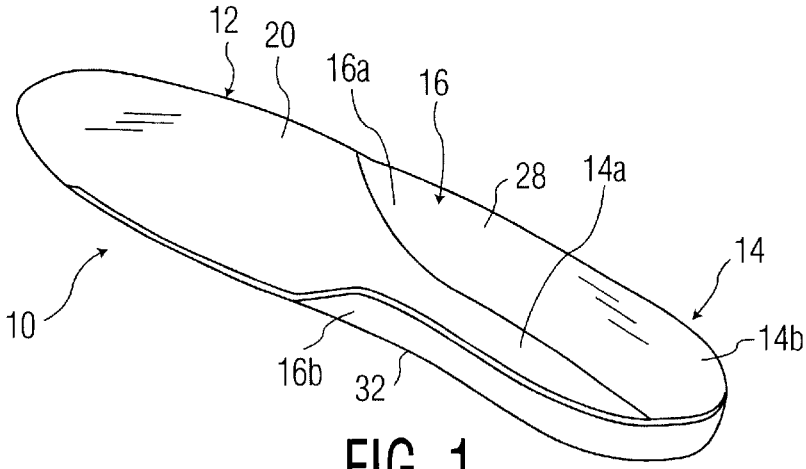
FIG. 1 is top perspective view of a left insole according to the present invention.

Referring to the drawings in detail, a left insole 10 according to a first embodiment of the present invention is adapted to be placed in an article of footwear, as is well known. A right insole (not shown) is identical to left insole 10 and is a mirror image thereof. Insole 10 is particularly adapted to alleviate back, hip, leg and foot pain in arthritic and diabetic people.

Insole 10 has the shape of a human left foot and therefore includes a curved toe or forefoot portion 12, a heel portion 14, and a mid-foot portion 16 which connects forefoot portion 12 and heel portion 14 together. Heel portion 14 has a greater thickness than forefoot portion 12. For example, heel portion 14 may have a thickness in the range of about 0.18 inch to 0.25 inch, with a preferred thickness of about 0.21 inch, while forefoot portion 12 may have a thickness in the range of about 0.14 inch to 0.22 inch, with a preferred thickness of about 0.18 inch.

Insole 10 is formed by a lower cushioning layer 18 and a top cover 20 secured to the upper surface of cushioning layer 18, along forefoot portion 12, cupped heel portion 14 and mid-foot portion 16, by any suitable means, such as adhesive, RF welding, etc.

In accordance with the present invention, lower cushioning layer 18 is formed in three distinct layers 22, 24 and 26. Specifically, heel portion 14 and mid-foot portion 16 are formed by first unitary layer 22, and forefoot portion 12 is formed by dual layers 24 and 26 of the same outer dimensions. Dual layers 24 and 26 are superimposed in exact alignment with one another and are positioned in front of unitary layer 22 to form an effective continuation thereof. Preferably, the connection of the front edge of unitary layer 22 to the rear edge of combined layers 24 and 26 occurs at the arch area of mid-foot portion 16, behind forefoot portion 12, where there is not much pressure from the foot.

The width and height (thickness) of unitary layer 22 at the front edge thereof are the same as the width and height (thickness) of the combined dual layers 24 and 26 at the rear edge thereof to effectively form a smooth continuity between layer 22 and the combined layers 24 and 26. As a result, top cover 20 forms a smooth continuous surface, without irregularities, on which a person steps.

Figure 2:
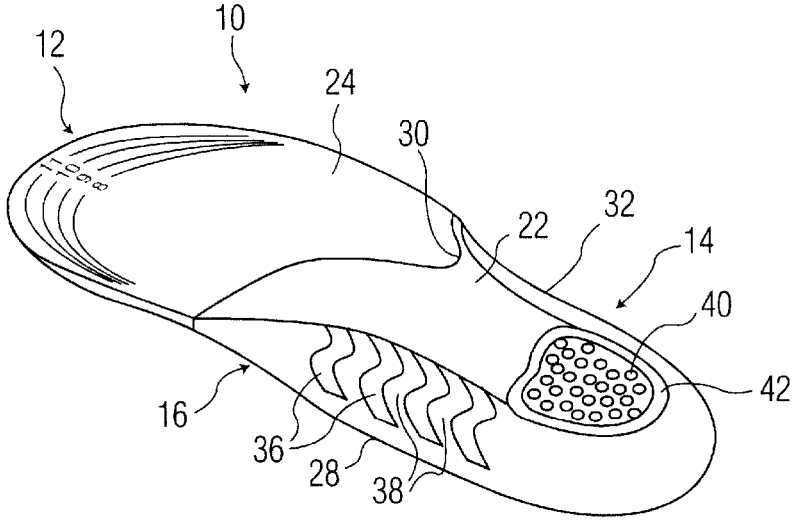
FIG. 2 is a bottom perspective view of a left insole according to the present invention.

As shown in FIGS. 1 and 2, unitary layer 22 extends forwardly to a further extent at the medial side 28 of insole 10, and is also formed with a curved recess 30 at the forward edge thereof at the lateral side 32 of insole 10. However, the present invention is not limited to this particular configuration.

Unitary layer 22 can be made from any suitable material including, but not limited to, any flexible material which can cushion and absorb the shock from heel strike on the insole. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees C. to 100 degrees C. may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymer XAS 10971.02 and polyol blend XUS 18021.00 available from the Dow Chemical Company, Midland, Mich.; and Niax 34-28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1 (CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers).

Preferably, unitary layer 22 is made from a urethane molded material.

In accordance with an important aspect of the present invention, dual layers 24 and 26 of forefoot portion are made from different materials, preferably polyurethane foam, having different characteristics. Preferably, layers 24 and 26 have the same thickness, which is preferably about 0.08 inch each. Specifically, the bottom layer 24 is made from a resilient foam material that provides a conventional cushioning function. In effect, bottom layer 24 is a typical foam mechanical spring, shock absorption layer that cushions the foot, in order to decrease pressure in any area of the forefoot. On the other hand, top layer 26 is made from a slow recovery foam material that has a conforming property. Thus, top layer 26 temporarily collapses under pressure, and absorbs the aforementioned shear, that is, dampens the same, and accommodates the shape of the foot. If there are bony protuberances, top layer 26 absorbs and redistributes the forces. Top layer 26 thereby sculptures to the pressure points and spreads the pressure out along the entire forefoot portion 12. Thus, by tuning the different layers 24 and 26, forefoot portion 12 optimally accommodates the deformation of the forefoot region of the foot, and reduces foot plantar pressure.

A preferred material for bottom layer 24 is the material sold by Rogers Corporation of Rogers, Conn. under the trademark "PORON" 5015, while the preferred material for top layer 26 is the material sold by Rogers Corporation of Rogers, Conn. under the trademark "PORON" 9612.

Recovery behaviors of "PORON" materials were determined by the following test method. First, the material was compressed to 75% of its original thickness, and then a step shear stress of 30 Kpa was applied for two seconds while the material was still under compression. The response, that is, the shear strain, was measured during the loading and unloading of the shear stress. The testing sequence, to some extent, mimics the stress situation encountered during the normal gait, which encompasses both the compressive and shear stresses.

The shear strain and shear stress of the resilient grade "PORON" 5015 material and the slow recovery grade "PORON" 9612 material were determined. The damping characteristic of the slow recovery "PORON" 9612 material of top layer 26 was rather vivid, so that there was no shock wave observed, since there was a smooth and slower decay of residual strain. On the other hand, it took about 0.3 second for the sinusoidal shock wave to dampen out in the residual grade "PORON" 5015 material of bottom layer 24.

The transient behavior of the slow recovery "PORON" 9612 material of top layer 26 was further quantified. Specifically, the shear strain at 2.0 seconds and the residual strain at 0.5 second were used to measure the flow recovery behavior of the foam. The results are provided in the following Table I.

Specifically, the aforementioned shear strain at 2.0 seconds is provided in column 3, while the residual strain at 0.5 second after unloading is provided in column 4. Column 5 identifies the recovery of the strain at 0.5 second after unloading in accordance with the following equation, where A is the shear strain at 2 seconds from column 3 and B is the residual shear strain at 0.5 second after unloading from column 4:

$$\text{Recovery}=(A-B)/A\times 100\%.$$

It is noted that Table I provides for the characteristics of bottom layer 24, top layer 26 and unitary layer 22, individually, in the first three rows, respectively, and provides the characteristics of two different samples of the superposed bottom layer 24/top layer 26 combination in the fourth and fifth rows.

TABLE I

| Material | Grade | Shear Strain @ 2 sec, % | Residual Shear Strain @ 0.5 sec after unloading (%) | Recovery @ 0.5 sec after unloading (%) |
|---|---|---|---|---|
| 5015 | Resilient | 3.8 | 0.8 | 78.9 |
| 9612 | Slow Recovery | 4.3 | 2.1 | 51.6 |
| 9415 | Slow Recovery | 12.4 | 4.4 | 64.5 |
| 9612/5015 Sample 1 | Dual Layers | 4.1 | 1.2 | 70.7 |
| 9612/5015 Sample 2 | Dual Layers | 3.3 | 1.0 | 69.7 |

From the above, it is clearly seen that the resilient grade "PORON" 5015 material has a much higher degree of recovery than that of the slow recovery grade "PORON" 9612 material. In summary, the resilient grade "PORON" 5015 material has a degree of recovery ranging from 75% to 100%, while the degree of recovery of the slow recovery grade "PORON" 9612 material ranges from 35% to 70%.

The preferred degree of recovery of the resilient grade "PORON" 5015 material ranges from 80% to 95%, and the preferred degree of recovery of the slow recovery grade "PORON" 9612 material ranges from 50% to 65%.

Top cover 20 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover 20 include good durability, stability and visual appearance. It is also desirable that top cover 20 have good flexibility, as indicated by a low modulus, in order to be easily moldable. The bonding surface of top cover 20 should provide an appropriate texture in order to achieve a suitable mechanical bond to the upper surface of lower layer 18. Preferably, the material of top cover 20 is a fabric, such as a brushed knit laminate top cloth (brushed knit fabric/urethane film/non-woven scrim cloth laminate) or a urethane knit laminate top cloth. Preferably, top cover 20 is made from a polyester fabric material, and preferably has a thickness of about 0.02 inch.

The materials of lower layer 18 can be prepared by conventional methods such as heat sealing, ultrasonic sealing, radio-frequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530, 489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, N.J., whose preparative teachings are incorporated herein by reference. For example, the innersole can be prepared by a foam reaction molding process such as taught in U.S. Pat. No. 4,694,589.

During use, insole 10 is placed in a shoe so that the medial side 28 containing a raised medial arch portion 16*a* of mid-foot portion 16 rests against the inside of the shoe. Forefoot portion 12 may end just in front of the metatarsals. Insole 10 is a full length insole, that is, extends along the entire foot.

Figure 3:
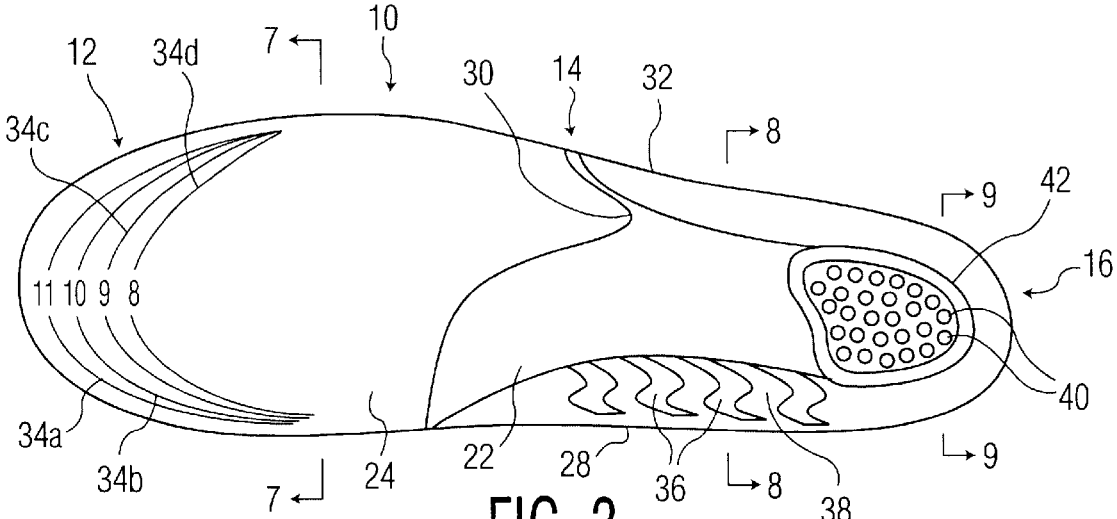
FIG. 3 is a bottom plan view of the left insole.
Figure 4:
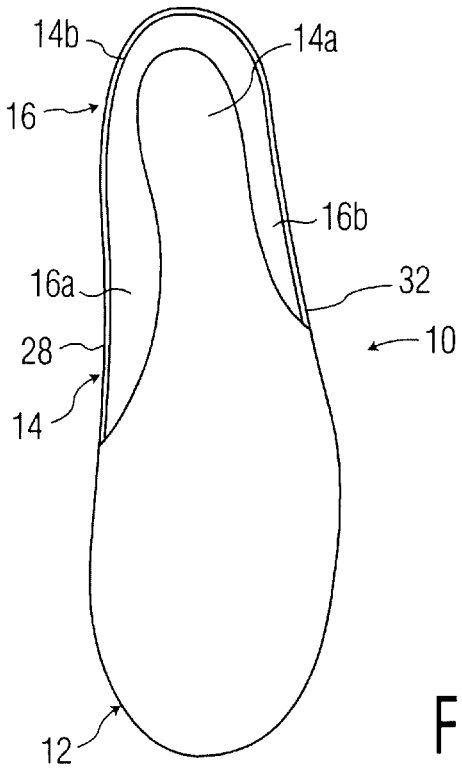
FIG. 4 is a top plan view of the left insole.
Figure 5:
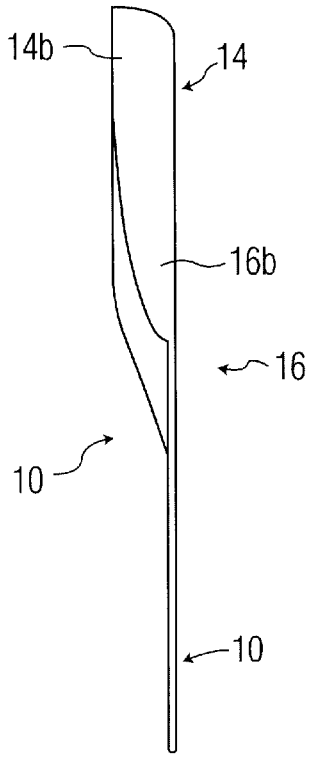
FIG. 5 is a side elevational view of the left insole.
Figure 6:
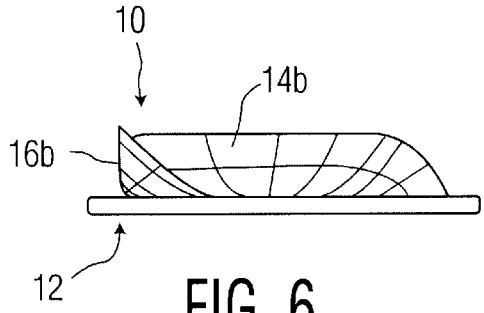
FIG. 6 is a front elevational view of the left insole.
Figure 7:
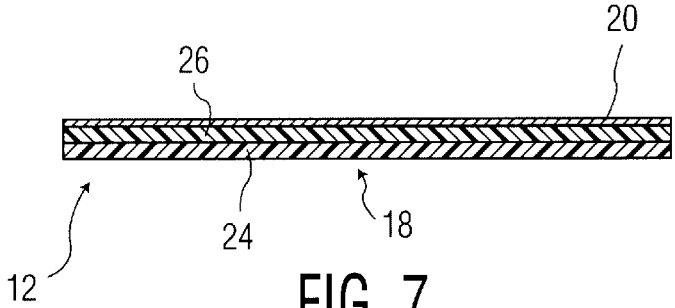
FIG. 7 is a cross-sectional view of the left insole, of substantially actual size, taken along line 7—7 of FIG. 3.
Figure 8:
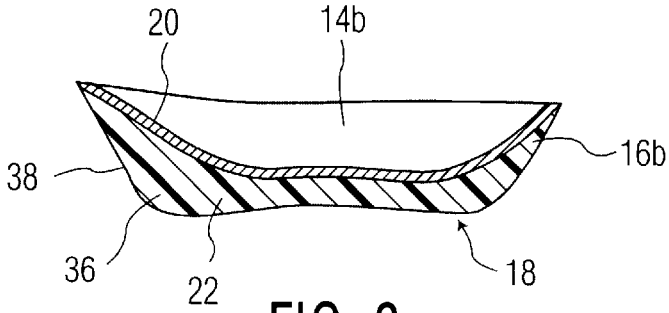
FIG. 8 is a cross-sectional view of the left insole, of substantially actual size, taken along line 8—8 of FIG. 3.
Figure 9:
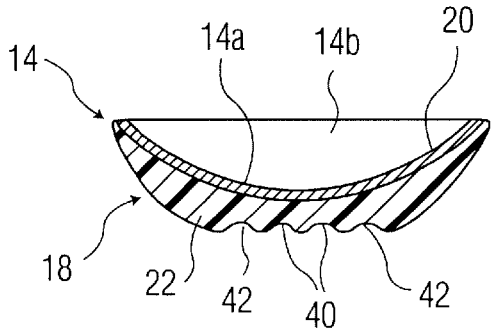
FIG. 9 is a cross-sectional view of the left insole, of substantially actual size, taken along line 9—9 of FIG. 3.

Typically, insole 10 would be sized corresponding to shoe sizes and would be provided in sized pairs. Alternatively, insole 10 may be trimmed to the requirements of the user. In this regard, arcuate pattern trim lines 34*a*–34*d* may be formed on the lower surface of forefoot portion 12 of insole 10, as shown in FIGS. 2 and 3, and which are representative of various sizes of the human foot. For example, insole 10 may be provided for a man's shoe size of 12, with first continuous pattern trim line 34*a* being representative of a smaller size insole for a man's shoe size 11, second continuous pattern trim line 34*b* extending around the periphery of forefoot portion 12 indicative of another size of insole for a man's shoe size 10, third continuous pattern trim line 34*c* extending around the periphery of forefoot portion 12 indicative of another size of insole for a man's shoe size 9, and fourth continuous pattern trim line 34*d* extending around the periphery of forefoot portion 12 indicative of another size of insole for a man's shoe size 8. If the user requires a size other than the original large size, the wearer merely trims the insole with a scissors or cutting instrument, using pattern trim lines 34*a*–34*d,* to achieve the proper size. The pattern trim lines may be imprinted by conventional printing techniques, silkscreening and the like. As an alternative, pattern trim lines 34*a*–34*d* may be formed as shallow grooves, or be perforated, so that a smaller size insole may be separated by tearing along the appropriate trim lines, which tearing operation is facilitated by the inclusion of perforations. Thus, forefoot portion 12 can be trimmed so that forefoot portion 12 fits within the toe portion of a shoe.

In addition to the forefoot structure, a cup-shaped arrangement is provided for the heel and mid-foot in order to stabilize the mid-foot and heel, while at the same time, providing overall cushioning and shock absorption of the mid-foot and heel. This is because there are joints in the mid-foot area and heel. If the foot is not held solidly, that is, without side to side movement, there will be much pain due to the excessive joint forces.

Specifically, as shown, heel portion 14 includes a relatively flat central portion 14*a,* and a sloped side wall 14*b*. Generally, when a heel strikes a surface, the fat pad portion of the heel spreads out. The cupped heel portion thereby stabilizes the heel of the person and maintains the heel in heel portion 14, to prevent such spreading out of the fat pad portion of the heel, and to also prevent any side to side movement of the heel in heel portion 14.

The side wall 14*b* of heel portion 14 extends forwardly to the mid-foot as a flange or side wall 16*b* on the lateral and medial sides of mid-foot portion 16, with side wall 16*b* extending to a further extent forwardly at the medial side to correspond to the medial arch portion 16*a* thereat. Side wall 16*b* thereby starts at heel portion 14 and extends at least to a midpoint of insole 10, to provide a foot cradle.

In addition to the above, medial arch portion 16*a* can be built into insole 10 in one of two ways. First, the arch portion can be filled or built up with a bulky cushioning material. This, however, provides the disadvantage that it might not be capable of use in a shoe already having a built in arch support, since it may be too bulky. Therefore, the preferred manner of forming medial arch portion 16*a* according to the present invention is to build up the height of medial arch portion 16*a,* but to provide spaced apart, transverse oriented grooves or recesses 36 therein, which define transverse flex members 38 between recesses 36 and which effectively function as springs. The advantage of using flex members 38 is that the bulk of medial arch portion 16*a* is not needed and thereby greatly reduced. It therefore becomes easier and better to use flex members 38 with shoes, since they can be used in shoes with or without a built in arch support. Flex members 38 function to provide even cushioning support and shock absorption over the entire mid-foot area during mid-stance phase. Because of flex members 38, the width of mid-foot portion 16 can be reduced. The use of flex members 38, by themselves, however, has been known in insoles sold more than one year ago.

Thus, flex members 38 define a flexural anatomical arch which creates arch support by flexion rather than just providing foam beneath the arch, and provides strength while also cushioning and providing a spring effect.

Heel portion 14 is provided with an air-dome heel cushion. Specifically, the underside of heel portion 14 is provided with substantially equally spaced apart hemispherical shaped recesses or depressions 40, separated by a lower surrounding surface being substantially coplanar with the lower surface of insole 10. An endless trough or recess 42 is provided in surrounding relation to hemispherical depressions 40. Depressions 40 and trough 42 effectively define spaced apart, elastic, resilient spring walls therebetween.

The reason for providing this arrangement which defines the spaced apart spring walls is that heel portion 14 is an area where major forces are exerted on insole 10 during heel impact. With this arrangement, the flexible and resilient spring walls, which are provided between adjacent depressions 40 and between depressions 40 and trough 42, provide a quicker acting spring than the remainder of the material of insole 10, but with less dampening energy absorption. Thus, when a force is applied to the material surrounding hemispherical depressions 40 and trough 42, the response is more like a spring than as a damper, while the remainder of heel portion 14 has an opposite response, that is, acting more like a damper than a spring. This combination gives insole 10 a unique feature of a fast reaction on first heel impact and a slower higher damped energy absorption as the heel recedes into insole 10. When the heel recedes from insole 10, the reverse action occurs, that is, the spring walls of the material surrounding hemispherical depressions 40 return some of the spring action to the heel. Thus, since the foam material which forms the same has much cushioning effect, depressions 40 and the surrounding material form a compression/expansion effect.

Tests were performed with different insoles. Specifically, five pair of flat prototype insoles were made for the tests as follows:

A. Control: a pair of flat single layer insoles having a predetermined thickness of 0.250 inch (250 mils) and made from a normal resilient "PORON" 4000-05-20250 material.

B. A dual layer insole having a total thickness of 0.250 inch (250 mils), with a top layer of normal resilient "PORON" 4000-01-12125 material and a bottom layer of slow-recovery "PORON" 4000-94-12125, which is one of the embodiments of the present invention, although not the preferred embodiment.

C. A dual layer insole having a total thickness of 0.250 inch (250 mils), with a top layer of normal resilient "PORON" 4000-01-12125 material and a bottom layer of slow-recovery "PORON" 4000-98-12125, which is one of the embodiments of the present invention, although not the preferred embodiment.

D. A dual layer insole having a total thickness of 0.250 inch (250 mils), with a top layer of slow-recovery "PORON" 4000-94-12125 material and a bottom layer of normal resilient "PORON" 4000-01-12125, which is the preferred embodiment of the present invention.

E. A dual layer insole having a total thickness of 0.250 inch (250 mils), with a top layer of slow-recovery "PORON" 4000-98-12125 material and a bottom layer of normal resilient "PORON" 4000-01-12125, which is the preferred embodiment of the present invention.

A total of ten female subjects, all being healthy, of normal height and weight, and wearing women's size 7.5 or 8 shoes, participated in the tests.

A capacitance in-shoe dynamic pressure measuring system which is sold under the trademark "PEDAR" by Novel Electronics Inc. of St. Paul, Minn., was used to measure and record in-shoe dynamic pressure distribution. The "PEDAR" system is an accurate and reliable pressure distribution measuring system for the monitoring of local loading of the foot inside a shoe. For example, the "PEDAR" system may include 100 pressure sensors associated with the insole. Further, a pair of photocells were used to monitor the walking speeds of the subjects.

After identifying the self-selected walking speeds, the subjects walked four times for each experimental condition. Pressure data collection started at the standing phase before the subjects made their initial acceleration. For each trial, the subjects were instructed to start walking with their right foot.

The subjects ranked the preference of the four dual-layer samples B–E from a ranking of 1 to 4, with ranking 1 being the most preferred. Based on the results, it was concluded that the subjects preferred having the slow recovery "PORON" material as top layer 26 in direct contact with their feet, with the normal resilient "PORON" material as bottom layer 24, as evidenced by the graphical diagram of FIG. 10, in which the lowest ranking numbers were achieved with samples D and E.

Figure 11:
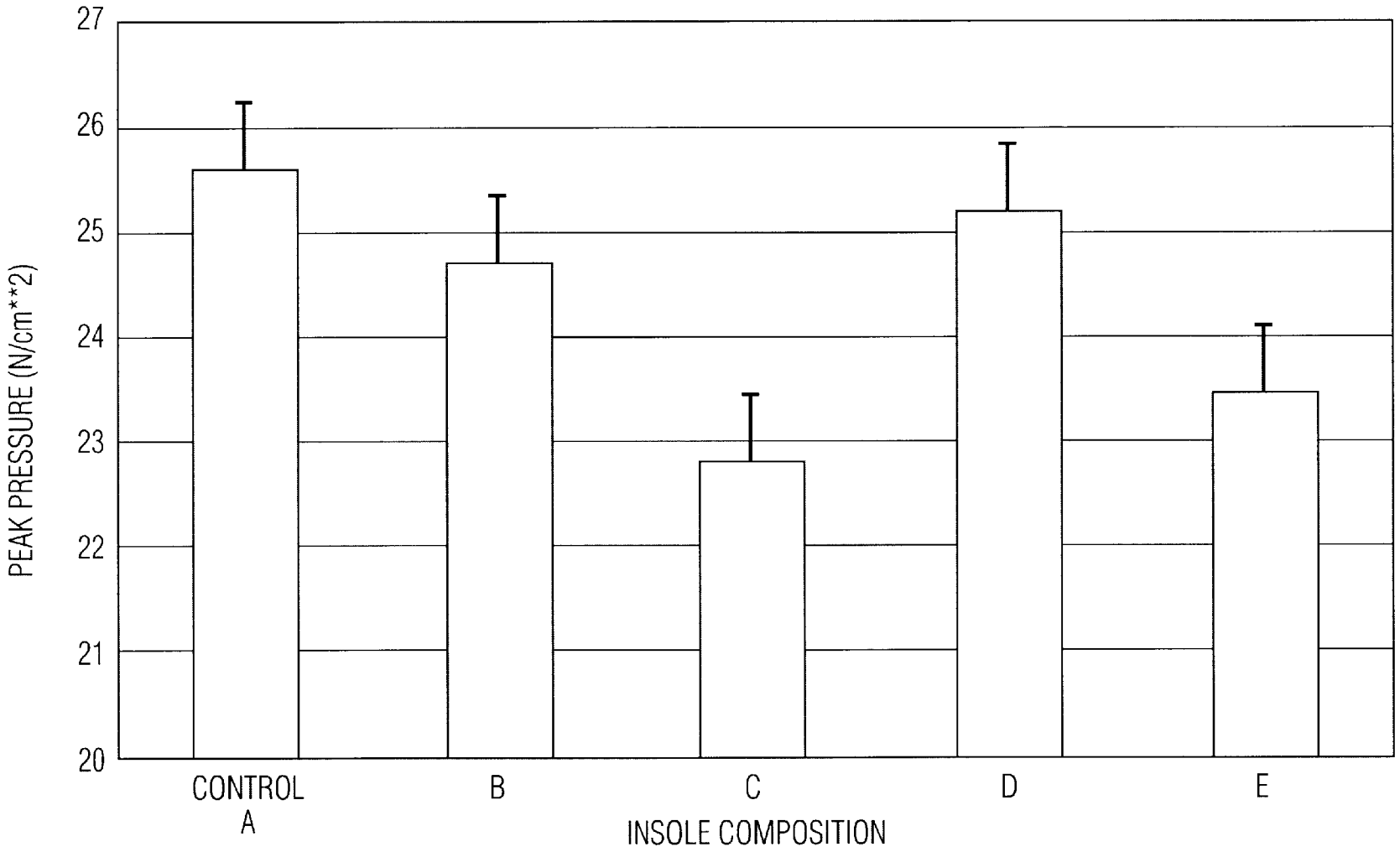
FIG. 11 is a graphical diagram of peak pressure under the first metatarsal head for different insoles.
Figure 12:
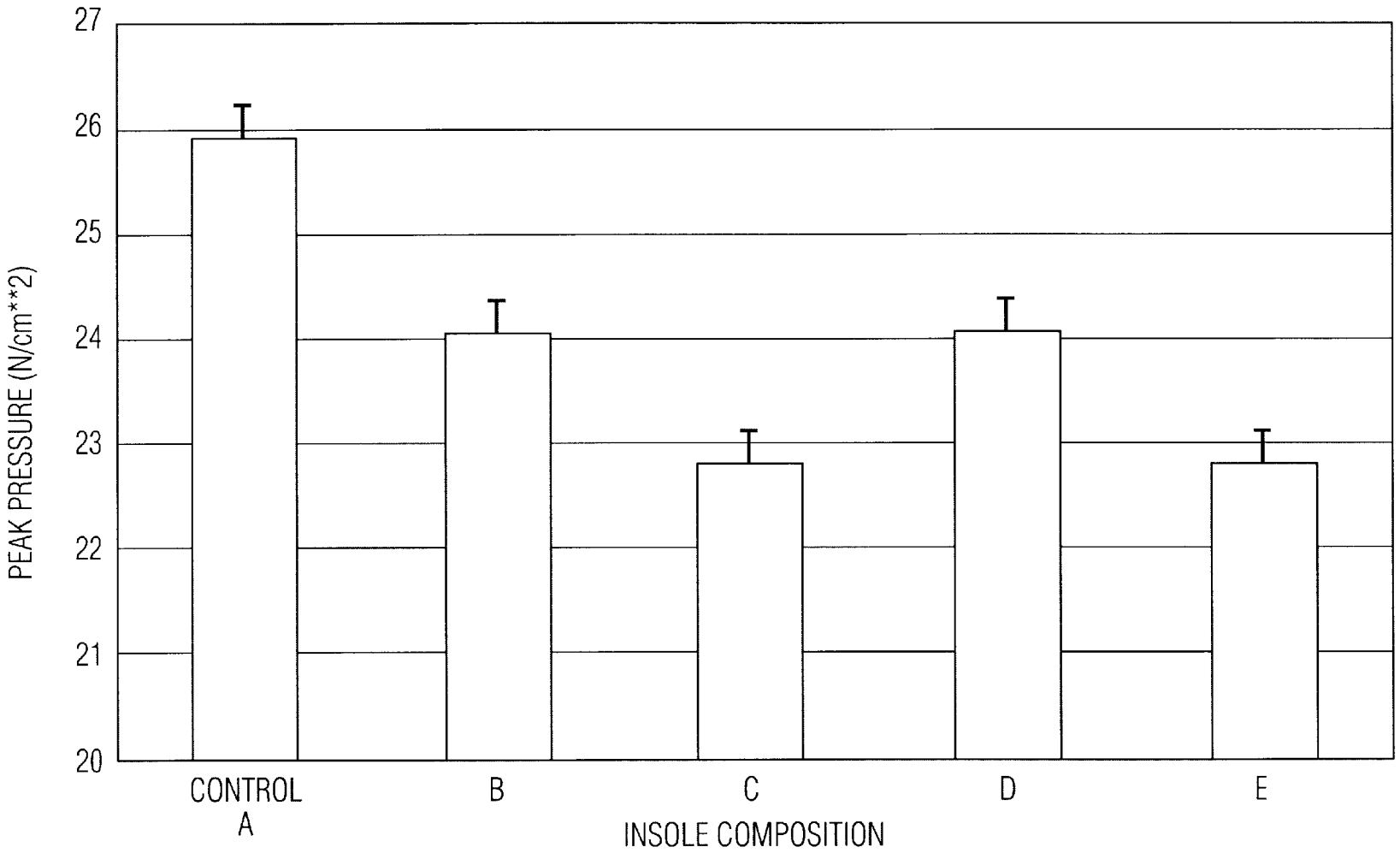
FIG. 12 is a graphical diagram of peak pressure under the second and third metatarsal heads for different insole.
Figure 13:
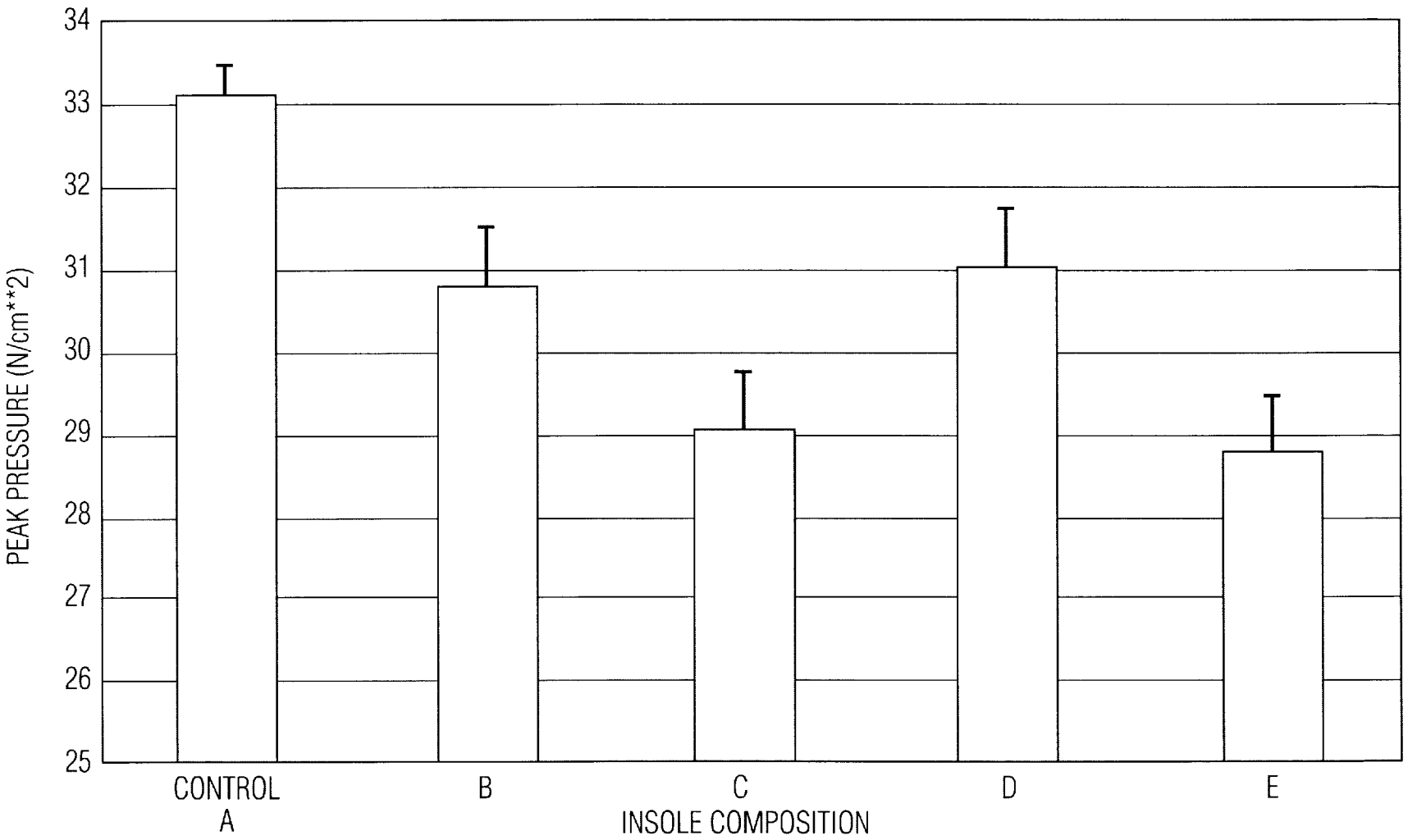
FIG. 13 is a graphical diagram of peak pressure under the hallux for different insoles.

Further, as to peak pressure under the metatarsal head, it was determined that control insole A had a higher peak pressure than all of the dual layer insoles B–D, as shown by the graphical diagrams of FIGS. 11–13. It was also determined that use of the stiffer formula, slow recovery "PORON" 4000-98-12125 as a top layer in sample E provided a lower peak pressure than the softer formula, slow recovery "PORON" 4000-94-12125 as a top layer in sample D.

Considering the adhesive and cloth material of top cover 20, it was determined that, to optimally reduce the peak pressure, at least a combination of "PORON" 4000-94-12125 material with a 12 pound density as the top layer and "PORON" 4000-01-12125 material with a 12 pound density as the bottom layer, was required. It was determined that the upper limit was the use of "PORON" 4000-98-12125 material with a 15 pound density as the top layer and "PORON" 4000-05-20125 material with a 20 pound density as the bottom layer.

Figure 10:
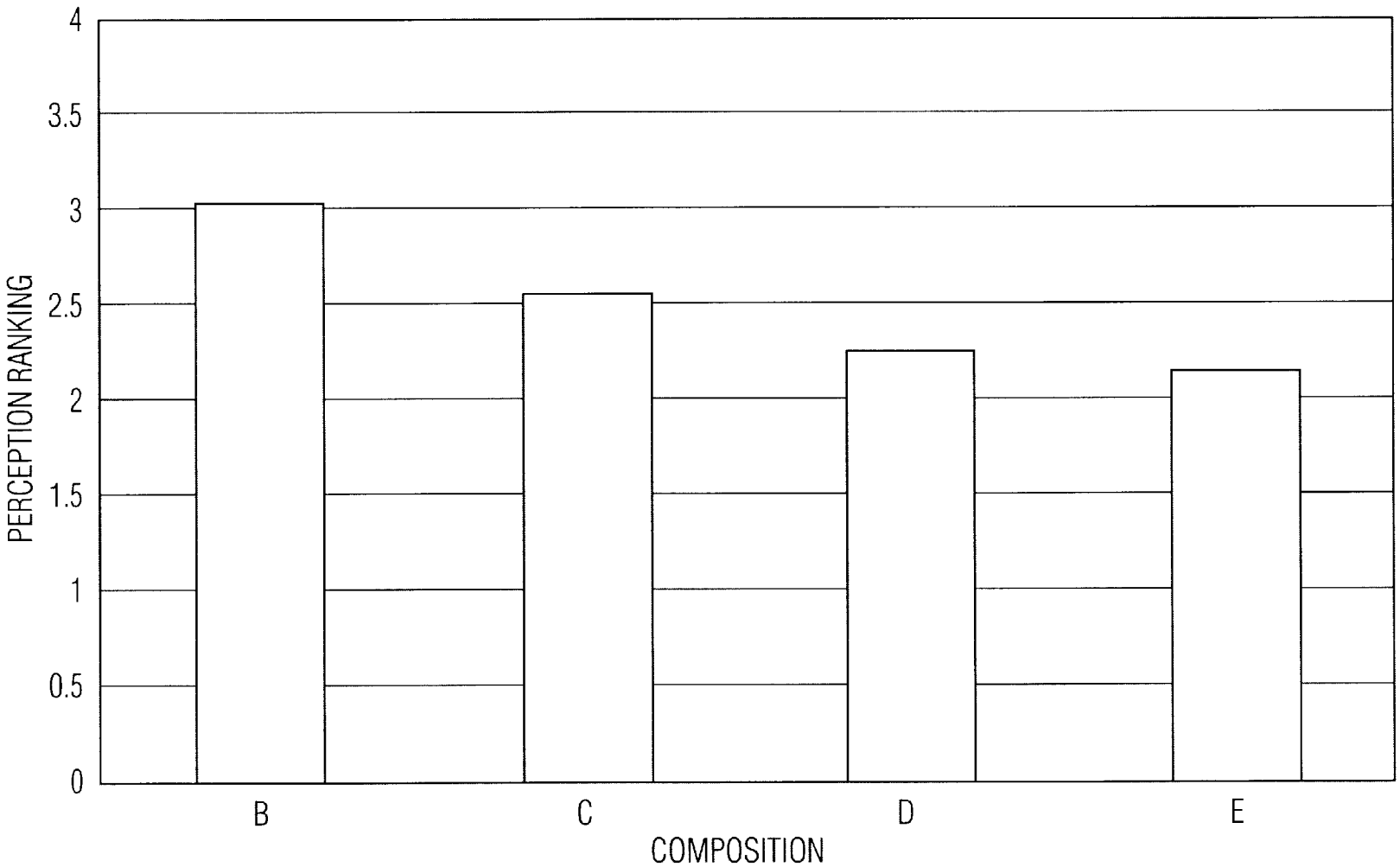
FIG. 10 is a graphical diagram of preference ranking for different insoles.

It was determined that, when normal resilient "PORON" 4000-01-12125 or 4000-05-12125 material was on top, as in samples B and C, the peak pressure had a trend of slightly lower pressure compared with the condition where the slow recovery "PORON" 4000-94-12125 or 4000-98-12125 material, was on top, as shown in FIGS. 11–13. However, the subjects preferred a direct contact with the slow recovery "PORON" 4000-94-12125 or 4000-98-12125 material, as shown in FIG. 10.

It is believed that this preference for slow recovery "PORON" 4000-94-12125 or 4000-98-12125 material on top, may be caused by the shear property of the slow recovery "PORON" 4000-94-12125 or 4000-98-12125 material.

From these tests, it can be determined that the slow recovery "PORON" material can be used with the present invention as either the top layer or the bottom layer, that is, samples B and D produced comparable results, and samples C and E produced comparable results in FIGS. 11–13. However, the preference on a subjective basis from FIG. 10 was the slow recovery "PORON" material as the top layer, and this constitutes the preferred embodiment of the invention.

Tests were then conducted with 29 arthritic and 34 diabetic subjects. Again, a capacitance "PEDAR" in-shoe pressure system was used to record in-shoe dynamic pressure distribution, and a pair of photocells were used to monitor the walking speeds of the subjects. The subjects again walked at their self-selected speeds four times for each experimental condition, and pressure data collection started at the standing phase before the subjects made their initial acceleration. The subjects were tested with insole E.

Figure 14:
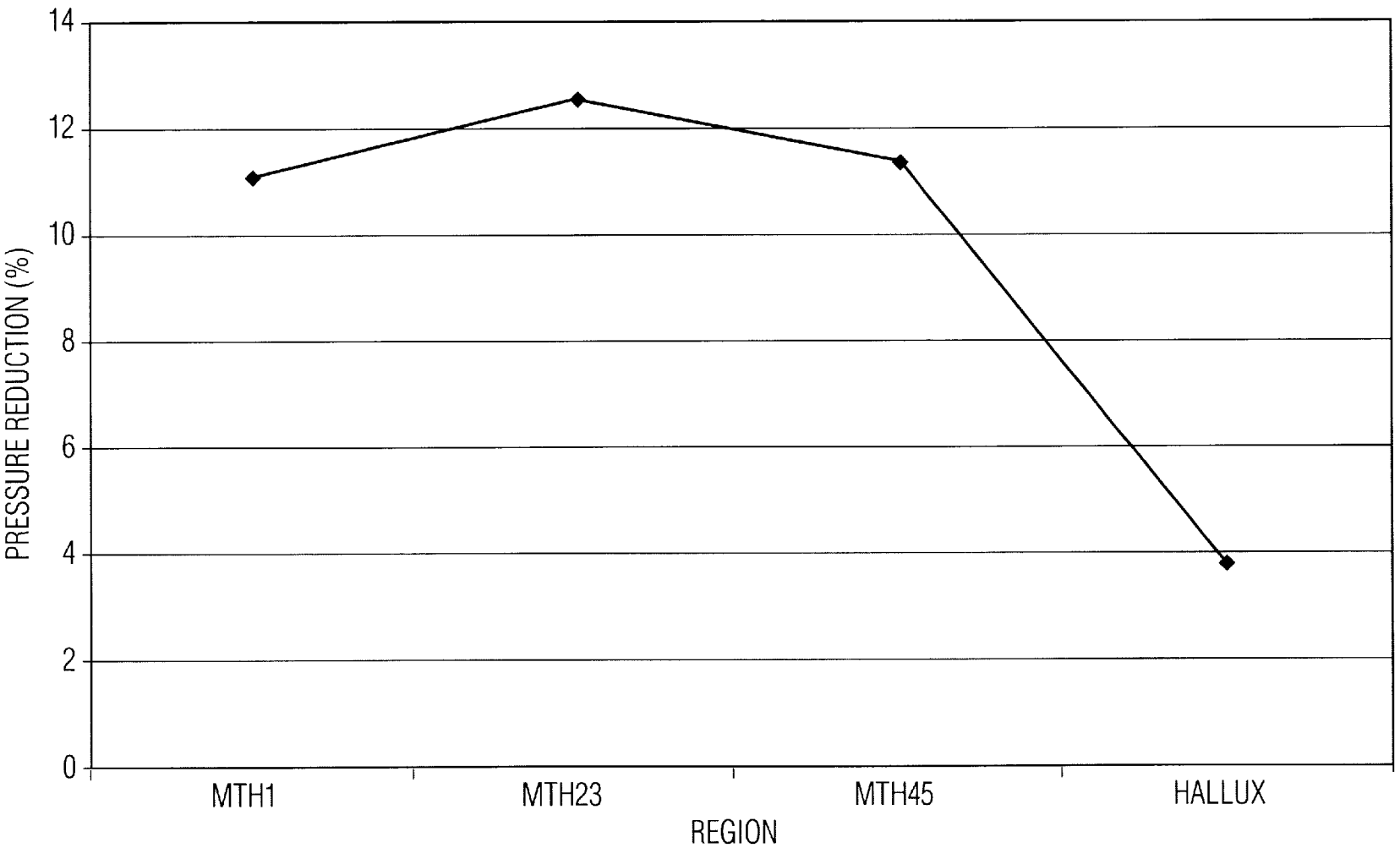
FIG. 14 is a graphical diagram of forefoot pressure reduction for arthritic people with the insole of FIG. 1.
Figure 15:
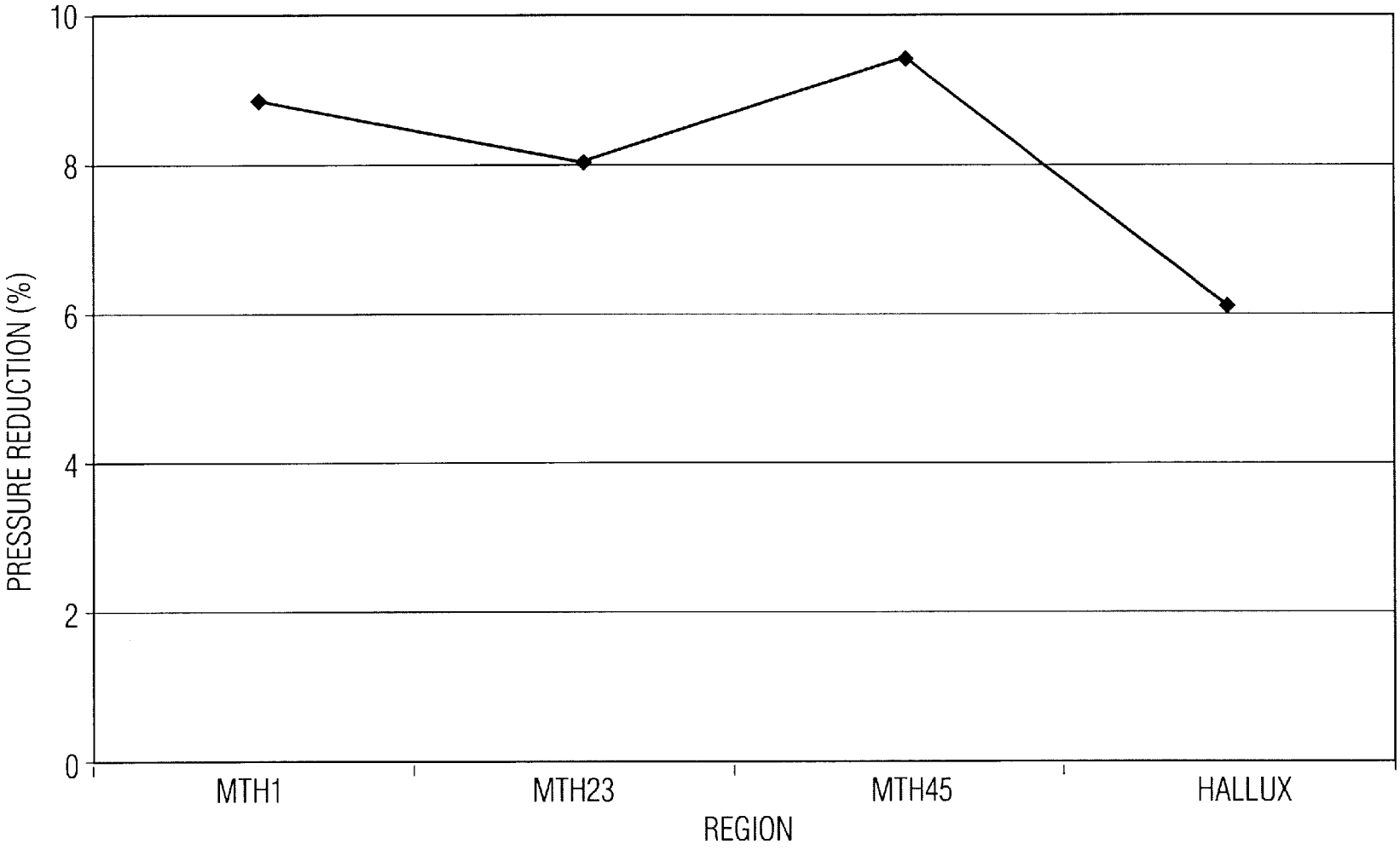
FIG. 15 is a graphical diagram of forefoot pressure reduction for diabetic people with the insole of FIG. 1.

The peak pressure reduction rate was used to evaluate the effectiveness of the insoles. The graphical diagram of FIG. 14 shows the peak pressure reduction rate in the regions of the first metatarsal head (MTH1), second and third metatarsal heads (MTH23), fourth and fifth metatarsal heads (MTH45) and the big toe (Hallux) in arthritic patients, while FIG. 15 shows the same graphical diagram for diabetic patients, for insole E. The reduction rate as a percentage is defined as follows:

$$RR(\%)=100\times(\text{pressure without insole}-\text{pressure with insole})/\text{pressure without insole}$$

Thus, using insole E, the following results were determined:

a) there was an average pressure reduction under the ball of the foot, that is, under the first through fifth metatarsals (MTH1, MTH23 and MTH45) in the range of about 8.0% to 12.5%;

b) the high profile construction formed by sloped side wall 14*b* and side wall 16*b* at heel portion 14 and mid-foot portion 16 resulted in increased midfoot support by about 6%; and c) the high profile construction formed by sloped side wall 14*b* and side wall 16*b* at heel portion 14 and mid-foot portion 16 relieved heel pressure by about 19.0% to 23.8%.

The aforementioned pressure reductions are in relation to the use of no insole, that is, the person wearing shoes without any insole versus the person wearing shoes with insole E.

Further, in subjective tests, over 80% of arthritic patients and 72% of diabetic patients felt that insole 10 according to the present invention significantly improved the comfort level upon completion of a three day wear test. Over 71% of arthritic patients felt the insole significantly relieved overall body pain throughout the day upon completion of the three day wear test. Finally, over 56% of diabetic patients felt that insole 10 enabled them to stay on their feet for a longer period of time.

Although the present invention uses the term insole, it will be appreciated that the use of other equivalent or similar terms such as innersole or insert are considered to be synonymous and interchangeable, and thereby covered by the present claimed invention.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

PARTS DESIGNATOR

10 insole
12 forefoot portion
14 heel portion
14*a* flat central portion
4*b* sloped side wall
16 mid-foot portion
16*a* raised medial arch portion
16*b* side wall
18 lower cushioning layer
20 top cover
22 unitary layer
24 bottom layer
26 top layer
28 medial side
30 curved recess
32 lateral side
34*a–d* arcuate pattern trim lines
36 transverse oriented recesses
38 transverse flex members
40 hemispherical shaped depressions
42 endless trough

What is claimed is:

1. A removable insole for insertion into footwear, comprising:

a forefoot portion extending at least to metatarsals of a foot, said forefoot portion including a combination layer formed only in the forefoot portion from:

a first layer of a resilient material which provides a shock absorption cushioning function, wherein said first layer is a bottom layer, and a second layer of a slow recovery material which absorbs shear forces applied to the second layer at pressure points and spreads out the shear forces along the forefoot portion, wherein said second layer has a degree of recovery in the range of 35 percent to 70 percent after a load has been removed for 0.5 seconds, said second layer having substantially the same outer dimensions as said first layer and superposed therewith, and said second layer is a top layer superposed on said bottom layer;

a heel portion; and a mid-foot portion connecting together said forefoot portion and said heel portion, said mid-foot portion including a medial arch portion.

2. A removable insole according to claim 1, wherein a rear edge of said combination layer is connected with a front edge of said mid-foot portion.

3. A removable insole according to claim 2, wherein said connection occurs at the medial arch portion.

4. A removable insole according to claim 1, wherein each of said first and second layers has a substantially identical thickness.

5. A removable insole according to claim 1, wherein said mid-foot portion and heel portion include a unitary layer of resilient material.

6. A removable insole according to claim 1, further comprising a top cover secured to upper surfaces of said forefoot portion, mid-foot portion and heel portion.

7. A removable insole according to claim 1, further comprising at least one pattern trim line at the forefoot portion for trimming the insole to fit into smaller size footwear.

8. An insole according to claim 1, wherein said medial arch portion has a height greater than a remainder of said mid-foot portion, and includes spaced apart, transverse oriented grooves at an underside thereof which define transverse flex members there between only in the mid-foot portion which effectively function as springs.

9. An insole according to claim 1, wherein said heel portion includes a plurality of depressions at an underside thereof which form spaced apart spring walls therebetween, said spring walls having lower edges generally coplanar with a lower surface of said heel portion.

10. A removable insole according to claim 1, wherein said heel portion is cupped so as to be formed by a relatively flat central portion and a sloped side wall.

11. A removable insole according to claim 1, wherein said sloped side wall extends around a periphery of said heel portion and forwardly to at least said mid-foot portion of the insole.

* * * * *